US006851199B1

(12) United States Patent
Zeitz

(10) Patent No.: US 6,851,199 B1
(45) Date of Patent: Feb. 8, 2005

(54) FOOTBALL MEASURING DEVICE AND METHOD

(76) Inventor: Israel Zeitz, 1656 SE. Haverford St., Port St. Lucie, FL (US) 34983

( * ) Notice: Subject to any disclaimer, the term of this patent is extended or adjusted under 35 U.S.C. 154(b) by 0 days.

(21) Appl. No.: 10/810,863

(22) Filed: Mar. 29, 2004

(51) Int. Cl.[7] ..... G01C 15/00; A63F 7/20

(52) U.S. Cl. ..... 33/289; 33/1 LE; 273/317.5; 273/108.4; 273/247; 473/477

(58) Field of Search ..... 33/285–286, 289, 33/1 G, 1 H, 1 LE, 413, 755–756, 623; 473/476–479, 480–492; 273/317.5, 108.4, 247

(56) References Cited

U.S. PATENT DOCUMENTS 2,060,165 A * 11/1936 Borleske ..... 33/289
2,384,150 A * 9/1945 Balmer ..... 33/556
3,181,241 A * 5/1965 Middleton ..... 33/289
3,738,014 A * 6/1973 Sproul, Sr. ..... 33/289
5,031,910 A * 7/1991 Kopp ..... 473/423
5,509,374 A * 4/1996 Trout ..... 33/1 H
5,937,532 A * 8/1999 Eirich et al. ..... 33/758
6,012,228 A * 1/2000 Fisanich ..... 33/289

* cited by examiner

*Primary Examiner*—G. Bradley Bennett
*Assistant Examiner*—Yaritza Guadalupe

(57) ABSTRACT

A football measuring device has a handle, a chain segment extending from the handle, and a bar mounted perpendicular to the handle. A removable clip is placed on the chain segment to mark the displacement of the football relative to the first down position.

4 Claims, 3 Drawing Sheets

FOOTBALL MEASURING DEVICE AND METHOD

BACKGROUND OF THE INVENTION

1. Field of the Invention

This invention relates to devices used in the game of football to measure forward progress by the offensive team in series of plays to determine whether a first down has been earned by sufficient forward progress. More specifically, the invention relates to football sideline chains.

2. Brief Description of the Prior Art

Football sideline chains have long been used in the game of football for measurement of yardage and the determination of first down situations. The sideline chain has consisted essentially of two vertical members, usually tubular poles, called markers that are connected by a chain that is attached to their respective bottoms. The sideline chain apparatus is used on the sideline of the football playing field. When one team begins a series of downs, one marker ("the first marker") is aligned with the leading end of the football, and the chain is pulled taut along the sideline toward the scoring or offensive goal line with the other marker ("the second marker") 10 yards distant from the first marker. If the offensive team gains 10 yards of forward progress, during a series of four downs, or plays, it earns another se of four downs. Sometimes the ball is carried on a play so near the 10-yard distance required that a determination of whether the requirement has been met is not dear with clear to the second marker on the sideline. In these situations the sideline chain is brought out onto the playing field for a more precise measurement allowed by bringing the second marker closer to the leading edge of the football. In making measurements on the field, the officials pick up both marker poles and the chain at the sideline. The chain is first marked at the point where the chain intersects the yard line, nearest the ball, and places that point of the chain on the same yard line on the field; but in direct alignment with the balls leading end. Only the distance along the chain between that point on the chain and the second marker (hereinafter referred to as the "measuring portion") is used to make the measurements on the field, and the first marker, although brought onto the field, does not enter into the measurement. The measuring portion of the chain is pulled taut by pulling the second marker towards the football's leading end to determine whether the football has been advanced sufficiently enough to earn another series of downs.

Football measuring devices of the prior art disadvantageously require moving the total chain from the sideline that is both poles with the attached 10 yard (30 feet) of chain, even though one of the poles and; a portion of the chain is not needed in the measurement. To make measurements rapidly, this may require three officials, one to carry each marker, and one to carry the chain. Also, the measurement must be taken from a line that intersects some portion of the chain between the first and second marker. Depending on how the official grasps the chain when be or she picks the chain up at the sideline, and bow the official sets it down in the field, some inaccuracy may be introduced into the measurement. In close contests a single such measurement can decide the outcome of the game, and accuracy in making such a measurement becomes critical.

Similarly, because football is often played during inclement weather, it is not unusual for prior art chains to accumulate mud, snow and/or ice when used under adverse conditions. This accumulation can disadvantageously change the effective length of the measuring chain to render it effectively shorter than the standard ten yards. As the chain is used and stretched at the start of each series of earned first downs, snow, ice or mud can accumulate between chain links and thereby shorten the actual ten yard distance between the marker pokes. This is to the advantage of the offensive team.

Further, when during play, defensive players often tackle or push the ball carrier out of bounds, so that the official holding the markers, on the sideline, are forced to drop them to avoid injury, introducing a source of error into measurement of the relative ball position because the markers and chain must be reset. These prior art football chain devices do not provide a solution to these problems.

U.S. Pat. Nos. 1,645,707; 1,684,566; 2,060,165; 2,384,150, 2,479,157; 3,678,592, 3,768,435 exemplify the prior art directly related to football sideline markers and U.S. Pat. No. 301,869 show a prior art surveyor's chain of background interest. Similarly, a surveyor'chains are also; unsuited to the problem. There is a continuing need for a football measuring device that can be used to provide rapid, accurate measurements of a team's progress down the field. U.S. Pat. No. 3,837,317 could possibly be altered to use on the playing field, although it was not intended to be used thusly. U.S. Pat. No. 5,189,803 is designed to be used on the field but uses a much different method than the present invention. Explanation of the differences between these, inventions and the present invention will be clearly shown in the claims portion, herein.

SUMMARY OF THE INVENTION

The present invention provides a football measuring device and a related method for determining the position of a football on a football field.

The football measuring device of the present invention comprises a handle having a base and a leg upstanding from the base. The handle has a major axis to be aligned parallel to the sidelines of the football field. The measuring device also includes a chain segment having an end secured to the handle and an extending bar releasably secured to the leg that is perpendicular to the major axis of the handle. The device also preferably includes a removable clip placed on the chain segment.

The measuring device of the present invention is preferably employed in conjunction with a conventional measuring device consisting of a first and second marker connected by a ten yard long chain. The football is located on the field in between a pair of yard lines. These, yard lines are any continuous line that extends from sideline to sideline. The method comprises positioning a first marker, or the conventional measuring device, at a position on a sideline corresponding to the position of the football on the field. The football measuring device is then positioned adjacent to the first marker, with the extending bar against the first marker, and, the chain segment extended taut in the direction of the nearest yard line. The hash marks, which are marked on the field, between the yard lines are not used with the present invention. The football measuring device can then be moved to the proximate the football, with the clip being aligned with a second yard line corresponding to, but ten yard distant from, the first yard line. The chain segment is then stretched taut parallel to the sideline; and the position of the football is inspected with respect to the extending bar. In this way an official can quickly and accurately determine whether a first down has been achieved, thus providing a rapid and accurate measure of a team's progress down the football field.

The present invention also eliminates or reduces the in inaccuracies associated with accumulation of ice, snow and/or mud in the measurement chain when football is played under adverse weather conditions. The measuring chain is substantially shorter than the ten-yard chain, presently employed, and can be cleaned before the clip has been set. Similarly, once the dip has been set, there is no need to keep the measuring device of the present invention adjacent to the sideline, where out-of-bounds play may endanger the officials responsible for the measurement of the footballs position.

BRIEF DESCRIPTION ON OF THE DRAWINGS

DETAILED DESCRIPTION OF THE DRAWINGS

Figure 1:
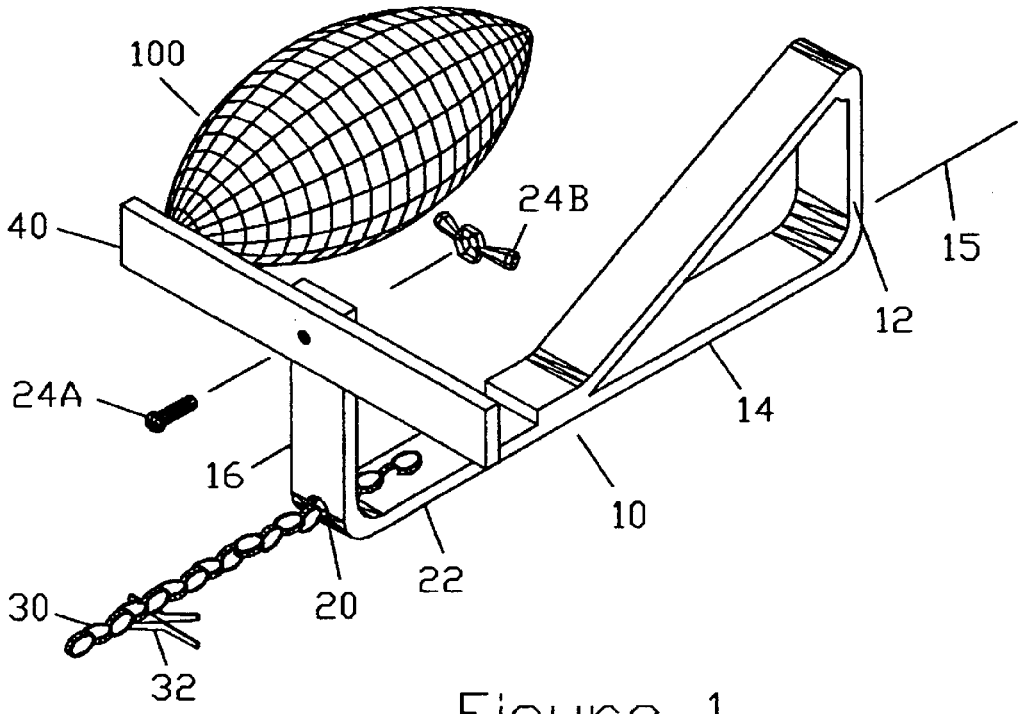
FIG. 1 is a perspective view of a football measuring device of the present invention.

Referring now to the drawings in detail wherein like reference numerals indicate like elements throughout the several views.

FIG. 1 shows a perspective view of a football measuring device 10 of the present invention. The football measuring device a handle 12, a measuring chain 30, and an extending bar 40. The handle 12 has a generally rectangular and generally flat base 14 for positioning the measuring device 10, of the present invention on the field, and a generally rectangular leg 16 extending perpendicularly upward from one end of the base 14.

Figure 2:
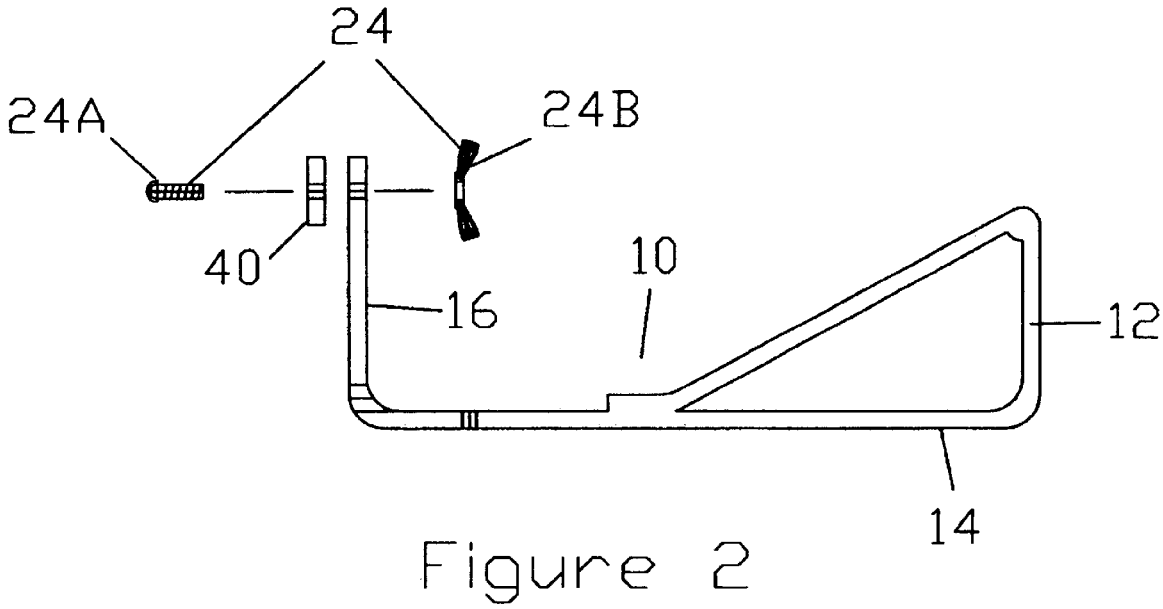
FIG. 2 is an exploded side view of the football measuring device of FIG. 1.

FIG. 2 shows how the extending bar 40 is secured at the top of leg 16 by a fastener 24, such as a bolt 24*a* and a wing nut 24*b*. This affords rapidly attaching or removing the bar 40.

An opening or aperture 20 is formed in measuring device 10, of the preset invention, at the bottom of the leg 16 adjacent to the base 14. The measuring chain segment 30 passes through the opening 20 and is secured to the base 14 by a rivet 22 or like means.

The measuring device 10, of the invention, is preferably made of a metal or another rigid material, having a thickness of approximately one-eighth of an inch (⅛"), such as a substantial plastic sufficiently strong so as to withstand heavy usage. Preferably the measuring device 10, of the present invention, is finished so it does not have sharp edges. As shown, the measuring device 10, of the present invention, can be formed from a single strip of metal stock with the ends of the strip spot welded or riveted, (not shown) to the base 14. The extending bar 40 is preferably formed from a rigid, corrosion resistant material, such as aluminum bar stock or a rigid plastic.

The chain segment 30 is preferably approximately eight feet in length and formed from a corrosion resistant metal or other strong material.

The football measuring device 10, of the present invent is used on a generally rectangular playing field having a pair of sidelines and a series of uniformly spaced lines that extend the width of the field from sideline to sideline. On a football field these lines are five yards apart (15 feet) and parallel; they will be referenced to as "five-yard" lines. Thus, "five-yard" line as used herein should be understood to refer to any yard line that is multiple of five yards (e.g. five-yard line, ten-yard line, fifteen-yard line, etc), and not just one of the two yard lines spaced five yards from the end zone of the field.

The method of the present invention employs the football measuring device of the present invention, and the nearest five-yard line to the football 100, whether it be forward or backward from the location of the football 100 (see FIG. 3 or 4) after play has stopped and an official has spotted the football 100, on the playing field, and a measurement is required before play can continue. The chain segment 30 need be only a little longer than the distance of seven and a half feet, that distance from any five-yard line to the mid-point between that five-yard line and the next adjacent five-yard line, where the football 100 is located.

Figure 3:
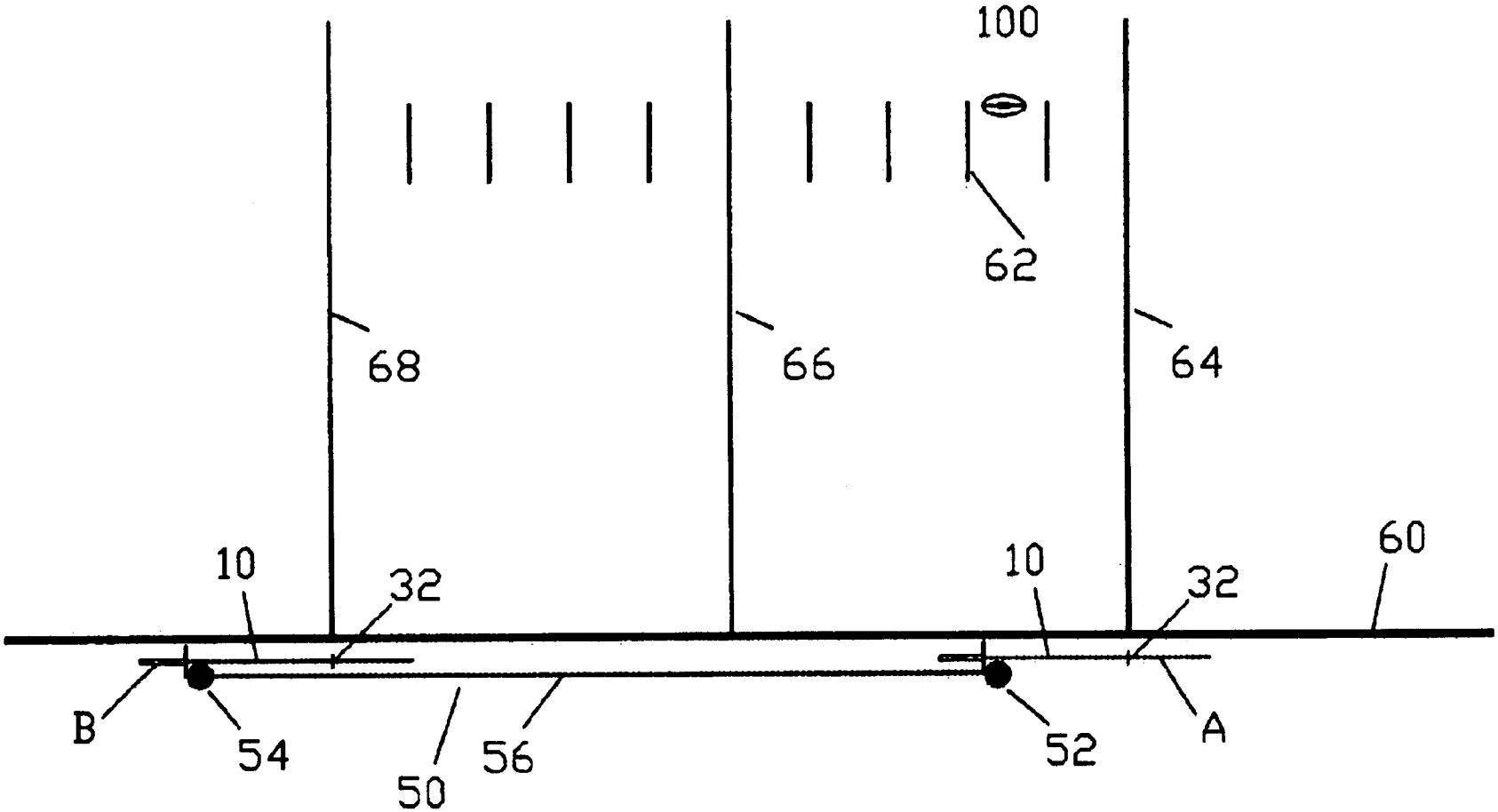
FIG. 3 is a fragmentary plan view of a football field showing the football measuring device of FIG. 1, present invention, placed in a first position (A) with reference to a first marker, or in a second position (B) with to the second marker, after the official has spotted the ball.
Figure 4:
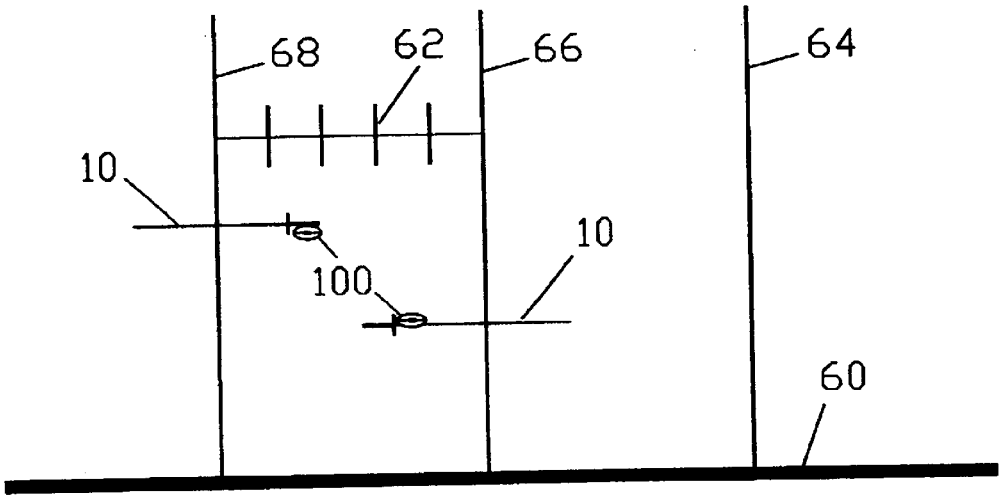
FIG. 4 is a plan view showing the football measuring device, of FIG. 1, being used to check if the football has been sufficiently advanced. The measurement shown as being made for two possible locations of the football.

As shown in the fragmentary plan view of FIG. 3, initially the football 100 is placed by the official in position on the playing field start a series of downs. This initial position or "first down" is the first in a series of four downs allotted to advance the football 100 the required ten yards to earn a new series of four downs, or forfeit the football 100 to the opposing team. The playing field is delimited by sidelines 60 (only one of which is shown in FIGS. 3 & 4) marked with chalk or paint on the turf. The five-yard lines 64, 66, 68 extend from sideline to sideline. Intermediate each pair of five-yard lines are a set of four short lines or "hash-lines" 62 located at one yard intervals from each other and the five-yard lines.

The football measuring device 10, of the present invention, can be used for on field measurements, from the nearest five-yard line, whether in the offensive or defensive direction, as shown in FIG. 4.

Referring to FIG. 3, a conventional measuring device 50 of the prior art comprises a first pole or marker 52 and a second pole or marker 54 connected by a ten yard length of chain 56. The first marker pole 52 is set on the sideline 60 at a point opposite the forward end of the football 100. The ten-yard chain 56 is stretched and the second marker 54 is placed ten yards forward in the direction of the offensive goal line (not shown). The extending bar 40 of the football measuring device 10, of the present invention, is the held against the forward side or the first marker 52 and the chain segment 30 is then stretched to the nearest five-yard line, either toward or away from the offensive goal line, whichever five-yard line is nearest the forward end of the football 100. The nearest five-yard line 64 shown in FIG. 3 is in the direction away from the offensive goal line.

A clip 32 is then affixed to the football measuring device 10, of the present invention, at thee point where the nearest five-yard line 64 intersects the short chain 30. The football measuring device 10, of the present invention, with clip 32 now attached is ready to be brought onto the playing field in the case that the football 100 is advanced so may to the point opposite the second marker 54, that a measurement need be made to determine if the required distance to earn a new series of downs has been obtained. The poles 52, 54 that were previously set remain in position on the sideline 60 until a first down has been made, or the team relinquishes the football 100, and the markers 52, 54 must be reset to the new position.

On occasion, during a set of downs, the football 100 is advanced a distance of approximately five yards. As the football 100 is in position to start the next down, the defensive team may commit a penalty of the five-yard type. The football measuring device 10, of the present invention, can be brought out to determine if the football 100 is short of the five yards pined to this point or beyond it. This method is more accurate than the prior art practice of stepping off the yardage and then measuring to the new spotting of the football 100. The football measuring device 10, of the present invention, is already set and ready for the measurement until a new series of downs has been earned.

FIG. 4 is a plan view showing the football measuring device 10 of FIG. 1 being used to check if the football 100 has been sufficiently advanced as to be awarded a new series of downs. The measurement shown as being made for two possible locations of the football 100.

In the case or the football 100 not being advanced quite far enough to award a new series of downs, and has been measured outside the hash marks 62 and the sideline 60, the conventional practice has been to use a portion of the ten-yard chain 56 to transfer the ball position between the hash marks 62, where it will be set for the next down. This makes it necessary to move the two connected poles 52, 54, along with the attached ten-yard chain 50, out onto the playing field to spot the exact position the forward end of the football 100 had reached. The football measuring device 10, of the present invention, eliminates the requirement of using the two marker poles 52, 54 and attached ten-yard chain 56, thereby saving the time otherwise needed to reposition them in their original position on the sideline 60, after such a measurements.

Figure 5:
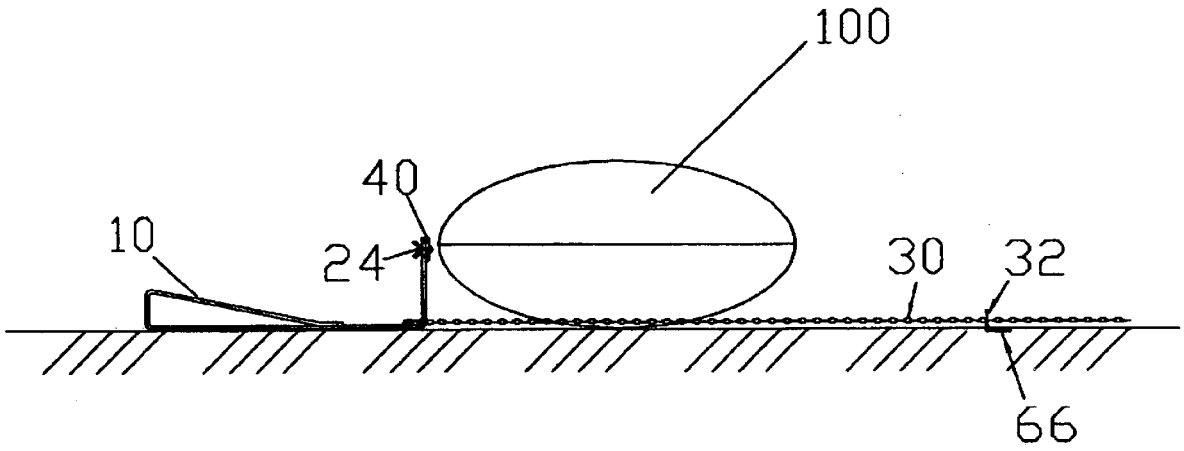
FIG. 5 is a side elevation view showing the football measuring device of FIG. 1, with the clip placed at the yard line, and the chain being stretched to check if the football has been moved in advance of the extending bar.

FIG. 5 is a side elevation view showing the football measuring device 10, of FIG. 1, with the dip 32 placed at the closest yard marker 66, and the chain 30 being stretched to check if the football 100 has been moved in advance of the extending bar 40, thus affording a new series of downs. As shown, the football 100 is short of the extending bar 40 and a new series of downs is not awarded Various other modifications can be made in detail of the various embodiments of the apparatus and method of the present invention, all within the scope and spirit of the invention and defined by the appended claims

I claim:

1. A football measuring device, comprising:

a handle having a base and a leg upstanding from the base a distance of approximately 4 inches, which corresponds to the distance from the ground to approximately the center of the nose of a football, said handle having a major axis along the base perpendicular to the yard lines and not parallel as some other devices are; a chain segment having an end secured to the base of the handle through an aperture provided in a lower section of the leg adjacent the base;

an extending bar releasably secured to an upper section of the leg away from the base, said bar extending parallel to the ground, and wherein said handle, said upright leg, said extending bar and any other part of the device does not have any dials, numbers or any sort of markings to designate where the device is located on the football field.

2. A football measuring device according to claim 1, further comprising a removable alligator type clip placed on the chain segment to indicate the distance along the chain length the extending bar is from the closest yard line.

3. A method for determining the position of a football on a football playing field having a pair of sidelines connected by a series of five yard lines and employing a conventional measuring device consisting of a first and second marker connected by a ten yard long chain, the method comprising:

positioning a first marker of the conventional measuring device at a position on a sideline corresponding to the position of the football on the field;

positioning a football measuring device adjacent the first marker, said football measuring device comprising a handle having a base and a leg upstanding from the base, the handle having a major axis;

a chain segment having an end secured to the handle; and an extending bar releasably secured to the leg perpendicular to the major axis of the handle;

said extending bar being positioned against the first marker;

stretching the chain segment taut in the direction of the five yard nearest to the position of the football, and placing an alligator type clip on the chain segment at a position corresponding to the nearest five yard line.

4. The method of claim 3, further comprising moving the football measuring device proximate the football, aligning the alligator type clip with a second five yard line corresponding to and ten yard distant from the first yard line;

stretching the chain segment taut parallel to the sideline; and inspecting the position of the football with respect to the extending bar.

* * * * *